United States Patent [19]

Itoh

[11] Patent Number: 4,829,712

[45] Date of Patent: May 16, 1989

[54] DOOR APPARATUS

[76] Inventor: Mituru Itoh, No. 2-6, Inohana 3-chome, Chiba-shi, chiba-ken, Japan

[21] Appl. No.: 210,276

[22] Filed: Jun. 23, 1988

[30] Foreign Application Priority Data

Dec. 18, 1987 [JP] Japan ..... 62-320840

[51] Int. Cl.[4] ..... E05D 15/28

[52] U.S. Cl. ..... 49/246; 49/386

[58] Field of Search ..... 49/386, 246, 253, 153, 49/345, 344, 339

[56] References Cited

U.S. PATENT DOCUMENTS 2,019,527 11/1935 Ellison ..... 49/386

3,456,388 7/1969 Hanson et al. ..... 49/386

*Primary Examiner*—Kenneth J. Dorner

*Assistant Examiner*—Gerald A. Anderson

*Attorney, Agent, or Firm*—Armstrong, Nikaido, Marmelstein, Kubovcik & Murray

[57] ABSTRACT

This invention relates to a novel door apparatus of the type wherein one door rotates while moving horizontally to the righ or left when opened, and finally approaches to the sidewall of an entrance and becomes in parallel therewith. The door apparatus of the invention is particularly suitable for the handicapped or those who use a wheelchair and who have difficulty in passing smoothly through doors in general.

1 Claim, 9 Drawing Sheets

DOOR APPARATUS

BACKGROUND OF THE INVENTION

1. Field of the Invention

This invention relates generally to a door apparatus and more particularly, to a novel door apparatus of the type wherein one door rotates while moving horizontally to the right and left when it is opened, finally approaches to the sidewall of an entrance and becomes parallel thereto.

2. Description of the Prior Art

The conventional doors have the structure wherein either the right or left side edge portion of the door is pivotally fitted to the sidewall of an entrance by hinges. Therefore, when one opens the door, the door swings greatly with the hinges being the support point. Since the door thus swings greatly, he must take a step backward when he pulls the door towards him. Generally, one passes through the door without opening it fully. In such a case, he must pass through while turning sideways.

Because the conventional door has the structure as described above, the door cannot be opened and closed smoothly and easily particularly by the handicapped or those who use a wheelchair and they have difficulty in passing through the door.

SUMMARY OF THE INVENTION

In order to eliminate the problems with the conventional doors described above, the present invention contemplates to provide a novel door apparatus having the structure wherein one door rotates while moving horizontally to the right and left when it is open, approaches eventually to the sidewall of an entrance and becomes parallel thereto, thereby eliminating the necessity of the trouble of taking intentionally a step backward or turning sideways when opening the door.

The above and other objects and novel features of the present invention will become more apparent from the following description when taken in conjunction with the accompanying drawings.

DESCRIPTION OF THE PREFERRED EMBODIMENT

Figure 1:
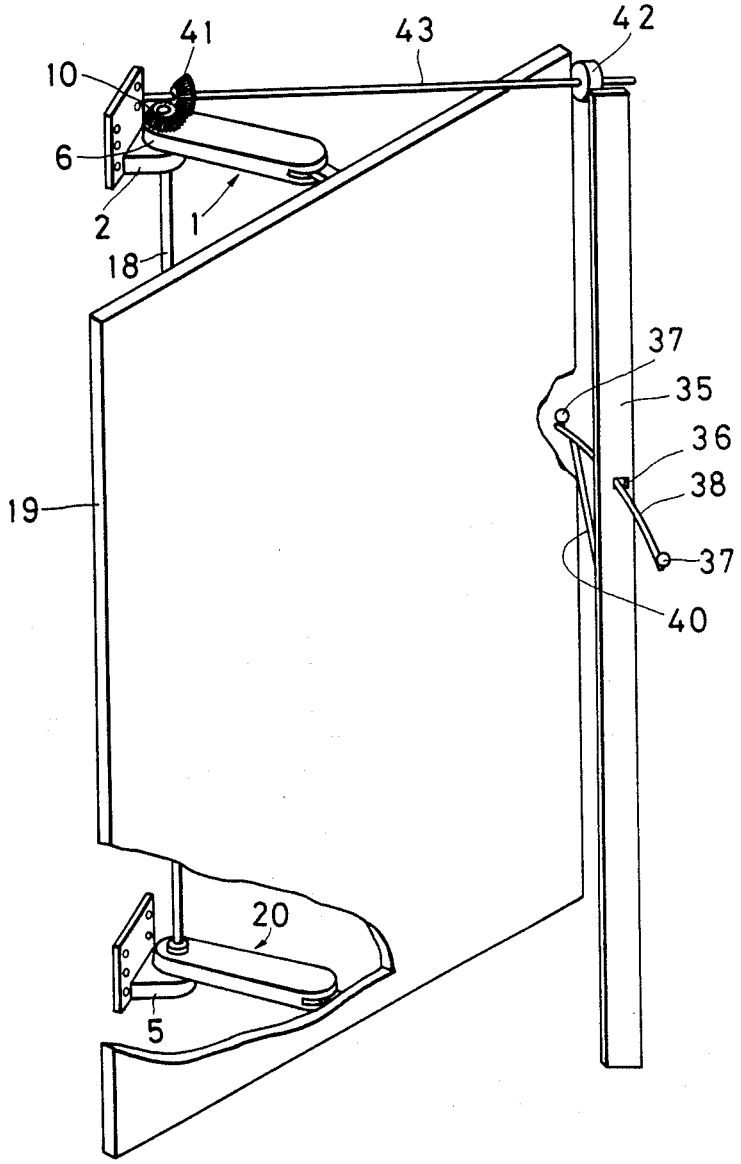
FIG. 1 is a partially cut-away perspective view of the door apparatus in accordance with one embodiment of the present invention.
Figure 2:
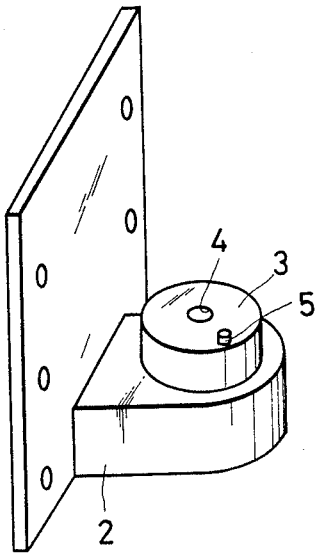
FIG. 2 is a perspective view of an upper support bed.
Figure 3:
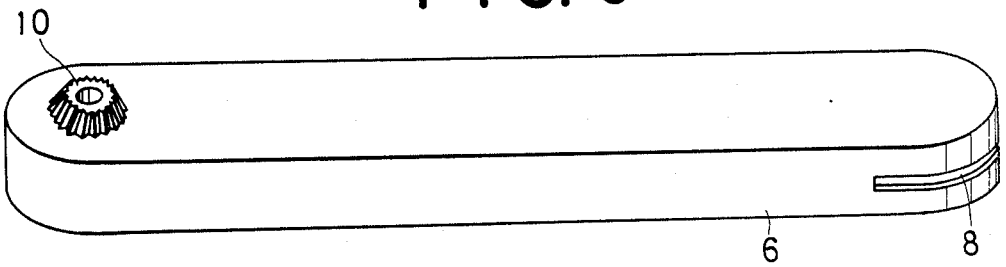
FIG. 3 is a perspective view of an upper support frame when viewed from top.
Figure 4:
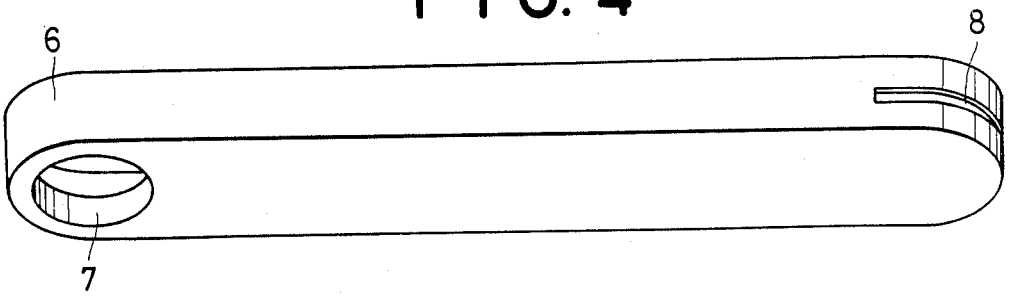
FIG. 4 is a perspective view of the upper support frame when viewed from bottom.
Figure 5:
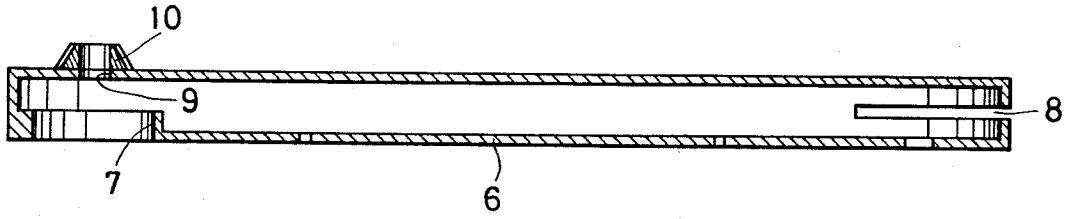
FIG. 5 is a longitudinal sectional view at the center of the upper support frame.

Hereinafter, a preferred embodiment of the present invention will be described in detail with reference to the accompanying drawings.

In the drawings, reference numeral 1 represents an upper stay which supports the upper end portion of the door. This upper stay 1 consists of a later-appearing support bed which is equipped with a round pillar, an upper support frame which rotates horizontally with the round pillar being the support point, a link one of the ends of which is connected to a pin implanted to the round pillar and the other end of which is connected to a pin of a later-appearing arm rod inside the upper support frame described above, a support shaft implanted to the bottom of the upper support frame and the arm rod which rotates horizontally with the support shaft being the support point and whose tip is connected to the door.

Figure 6:
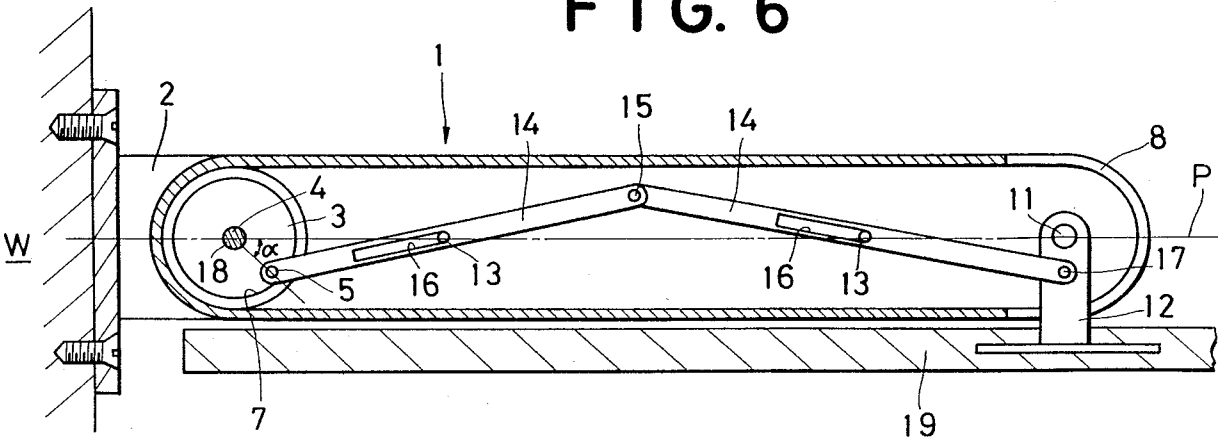
FIG. 6 is a partially cut-away plan view of an upper stay when the door is fitted to the sidewall of an entrance.
Figure 7:
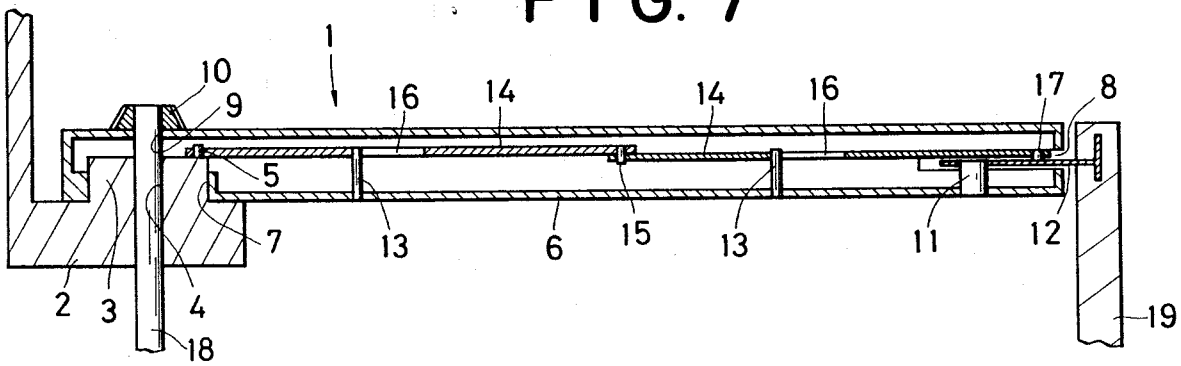
FIG. 7 is a longitudinal sectional view at the center of the upper stay when the door is being open.
Figure 8:
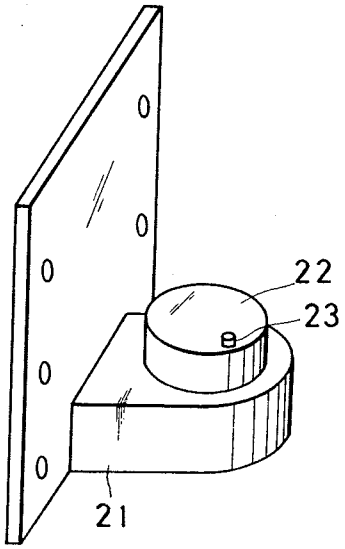
FIG. 8 is a perspective view of a lower support frame when viewed from top.
Figure 9:
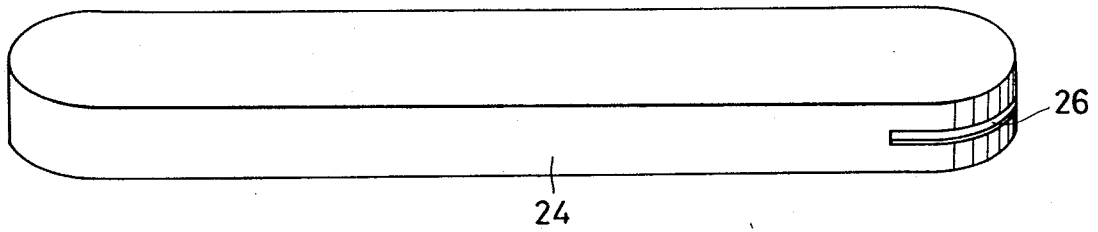
FIG. 9 is also a perspective view of the lower support frame when viewed from top.
Figure 10:
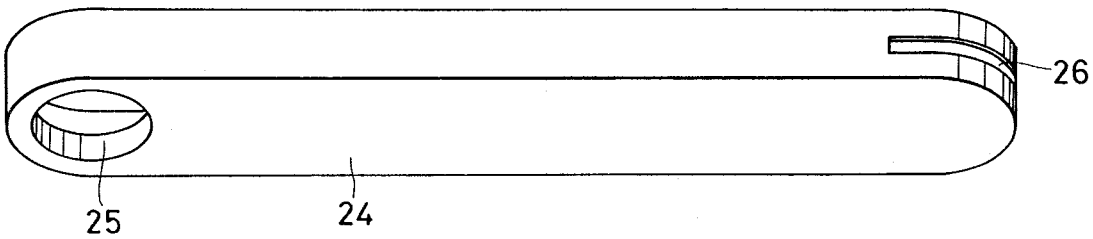
FIG. 10 is a perspective view of the lower support frame when viewed from bottom.
Figure 11:
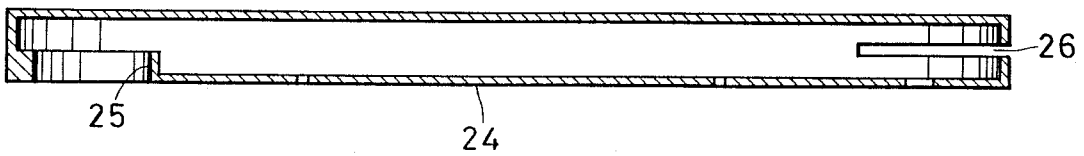
FIG. 11 is a longitudinal sectional view at the center of the lower support frame.
Figure 12:
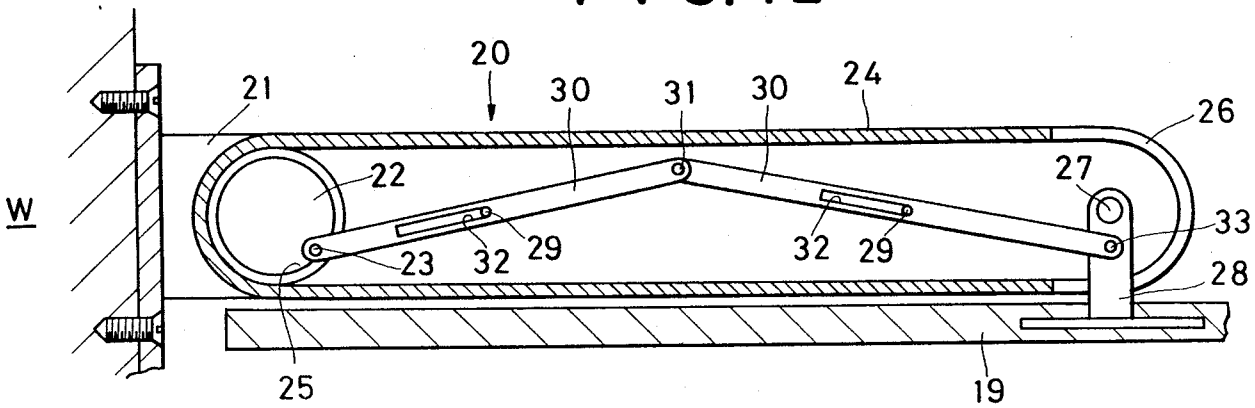
FIG. 12 is a partially cut-away plan view of a lower stay when the door is fitted to the sidewall of the entrance.
Figure 13:
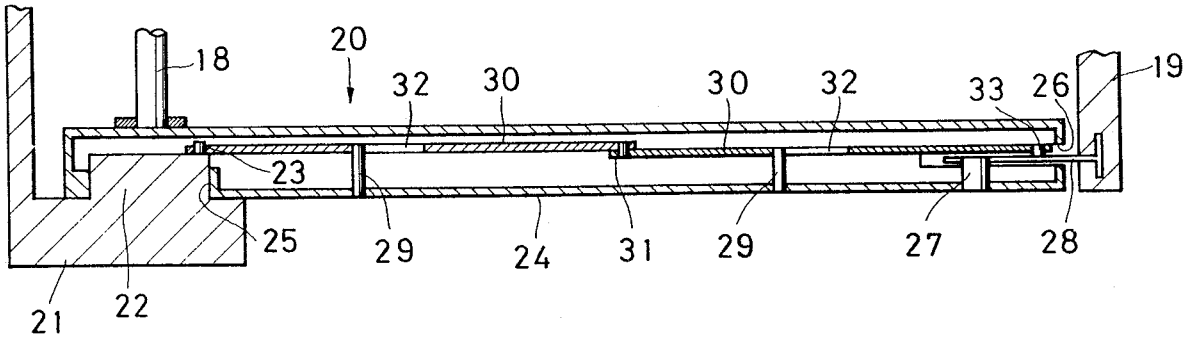
FIG. 13 is a longitudinal sectional view at the center of the lower stay when the door is being open.

Reference numeral 2 represents the upper support bed, which is fixed to the upper part of a sidewall W of the entrance in such a manner as to expand horizontally, and has the round pillar 3 projecting from its flat upper surface. A through-hole 4 is bored at the center of the round pillar 3 and a later-appearing interlocking shaft is fitted into this through-hole 4. A pin 5 is implanted at an eccentric position on the upper surface of the round pillar 3. This pin 5 is implanted at a diagonal position of 45° relative to the center line of the entrance in the entering direction with the center line being at right angles to the sidewall W of the entrance and being also the reference. Incidentally, symbol $\alpha$ in FIG. 6 represents the implantation angle of the pin 5 relative to the line P orthogonal to the sidewall W of the entrance, and is 45° as described above.

Reference numeral 6 represents the upper support frame which rotates horizonatally with the round pillar 3 being the support point of rotation. It is rounded at both end portions and has an elongated box-like shape. A round pillar fitting hole 7 is formed on the bottom at one end part of the upper support frame 6 and the round pillar 3 is rotatably fitted into this fitting hole 7. An elongated hole 8 is formed on an arc-shaped sidewall at the other end part of the upper support frame 6, and a hole 9 is formed at the ceiling part on the side of the round pillar fitting hole 7 so that the upper end part of a later-appearing interlocking shaft is fitted into the hole 9.

Reference numeral 10 represents a bevel gear which is fixed to the upper surface of the ceiling part of the upper support frame 6 on the side of the round pillar fitting hole 7. The upper support frame 6 is rotated horizontally when the bevel gear 10 rotates.

Reference numeral 11 represents a support shaft, which is implanted to the end part inside the upper support frame 6 on the opposite side to the round pillar 3. The tip of this support shaft serves as the support point for rotating horizontally the arm rod 12 which is connected to the center of the door in the transverse direction.

Reference numeral 13, 13 each represents a pin, which is implanted to the bottom inside the upper support frame with a predetermined spacing between them and is positioned on the line connecting the center of the round pillar 3 to that of the support shaft 11.

Reference numeral 14, 14 each represents a set of links connected to one another by a pin 15. Each link 14 is equipped with an elongated hole 16 into which the pin 13 described above fits slidably. One of the ends of the link 14 is connected to the pin 5 of the round pillar 3 while the other end is connected to a pin 17 implanted substantially at the center of the arm rod 12 in the axial direction. The full length of the link 14, 14 is in agreement with the gap between the center of the round pillar 3 and the center of the support shaft 11.

Reference numeral 18 represents an interlocking shaft, which rotates a later-appearing lower support frame in the interlocking arrangement with the rotation of the upper support frame 6 in the horizontal direction. The interlocking shaft 18 is fitted into the hole 4 of the upper support bed 2 and is connected to the ceiling part of the upper support frame 6. Its lower end part is connected to the ceiling part of the later-appearing lower support frame. Incidentally, in the embodiment shown in the drawings, the upper end of the interlocking shaft 18 is shown fitted and fixed into the hole 9 of the upper support frame 6.

Reference numeral 19 represents a door. The upper and lower end portions of the door at the center in its transverse direction are supported by the arm rod 12 described above and by an arm rod of a later-appearing lower stay.

Reference numeral 20 represents the lower stay described above. The lower stay 20 consists substantially of the same constituent elements as the upper stay 1. Therefore, detailed description of each constituent element will be omitted.

Reference numeral 21 represents a lower support bed; 22 is a round pillar; 23 is a pin implanted to the round pillar 22; 24 is a lower support frame; 25 is a round pillar fitting hole; 26 is an elongated hole; 27 is a support shaft; 28 is an arm rod; 29, 29 are pins; 30, 30 are links connected by a pin 31; 32, 32 are elongated holes into which pins 29, 29 are fitted; and 33 is a pin implanted to the arm rod 28.

Reference numeral 34 represents a driving mechanism of the upper stay 1, which is a manual driving mechanism in this embodiment.

The manual driving mechanism 34 consists of an operation rod 38 which is inserted through an operation rod insertion hole 36 on an enclosure plate 35 fixed to the side wall of the entrance and which is equipped at its both end portions with knobs 37, 37, a lever 40 whose upper end is connected to the rear end part of the operation rod 38 and whose lower end is fitted pivotally to the lower rear surface of the enclosure plate 35 by a shaft rod 39 in such a manner as to be capable of rocking, a rotary shaft 43 which is extended horizontally on the upper rear surface of the enclosure plate 35 and which is equipped at one of its ends with a bevel gear 41 meshing with the bevel gear 10 fixed to the upper support frame 6 and at the other end with a disc 42 fixed thereto, and a connecting rod 46 whose one end part is connected pivotally to substantially the center of the lever 40 in the axial direction by a pin 44 and whose other end part is connected to a pin 45 implanted to an eccentric position of the disc 42 of the rotary shaft 43 described above.

Incidentally, the position of implantation of the pin 45 of the disc 42 is deviated by 45° diagonally downward in the entering direction of the door from the line P' connecting the axis of the rotary shaft 43 to the axis of the pin 44.

Though this embodiment illustrates the use of the manual driving mechanism, an electric driving mechanism using a motor, or the like, can also be employed.

Next, the operation of the door apparatus of the present invention having the construction described above will now be explained.

Figure 14:
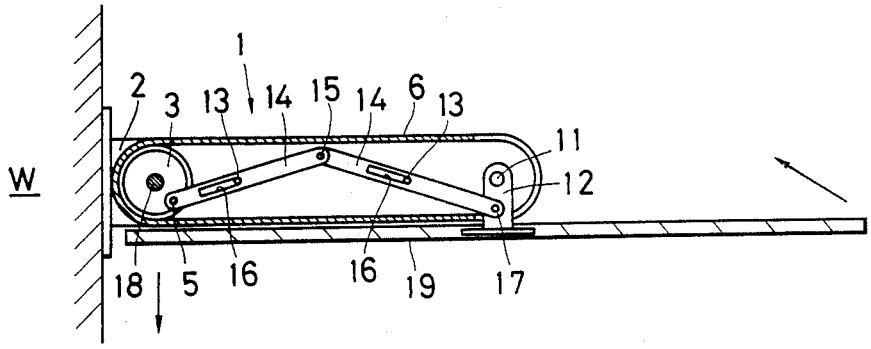
FIGS. 14 to 16 are explanatory views useful for explaining the modes of operation of the upper stay.

FIG. 14 shows the state where the door 19 is closed. When one approaches to the door 19 and pulls the operation rod 38 towards him by gripping the knob 37, the lever 40 rocks in the direction represented by arrow with the shaft rod 39 being the support point. Then, the connecting rod 46 is pushed up and its upper end part pushes the pin 45 implanted at the eccentric position of the disc 42. In consequence, the rotary shaft 43 rotates and rotates the bevel gear 10 of the upper support frame 6 meshing with the bevel gear 41 of the rotary shaft 43, so that the upper support frame 6 is rotated horizontally with the round pillar 3 of the upper support bed 2 being the support point of rotation.

On the other hand, the rotation of the upper support frame 6 is transmitted to the lower support frame 24 through the interlocking shaft 18 and the lower support frame 24, too, rotates horizontally with the round pillar 22 of the lower support bed 21 being the support point of rotation. When the upper and lower support frames 6 and 24 start rotating horizontally in the direction represented by arrow in FIG. 14, the door 19 starts rotating towards the sidewall of the entrance on the side of the upper and lower support beds 2, 21 as represented by arrow.

For, the links 14, 14, 30, 30 in the upper and lower support frames 6, 24 become gradually straight from their bent state with the rotation of the upper and lower support frames 6, 24, respectively, and when these links 14, 14, 30, 30 become straight, the pins 17, 33 of the arm rods 12, 28 are pushed out as much, respectively.

Figure 15:
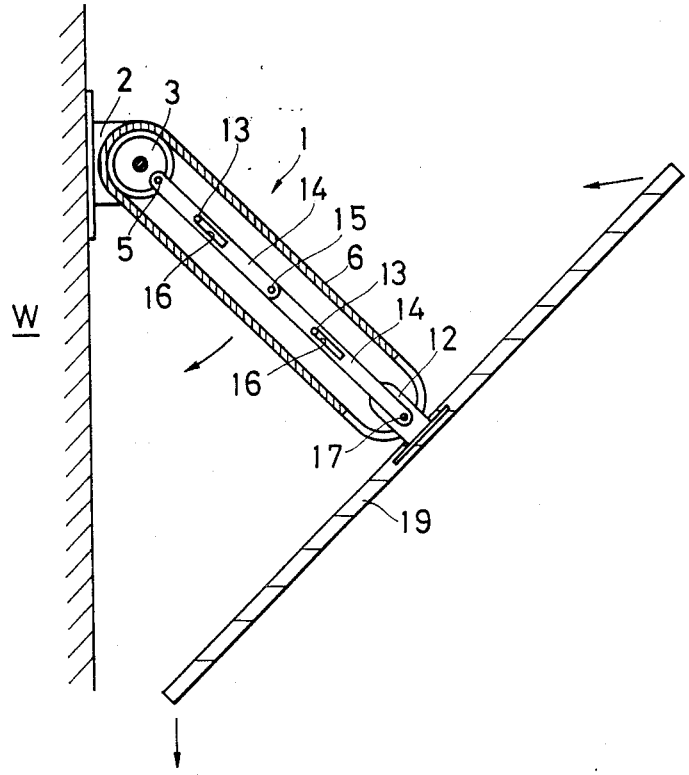
Figure 16:
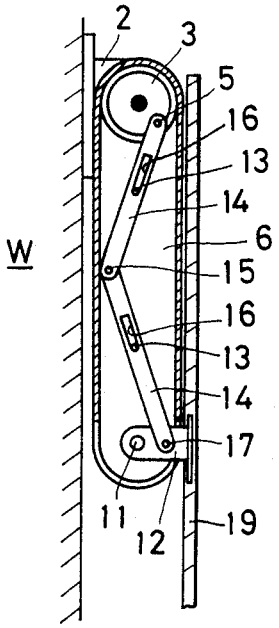
Figure 17:
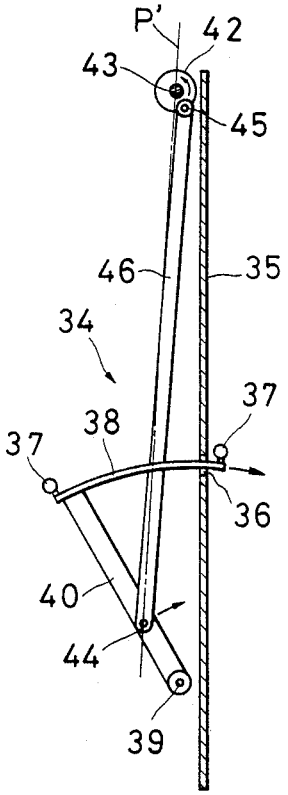
FIG. 17 is an explanatory view of a driving mechanism of the upper stay.

When the upper and lower support frames 6 and 24 rotate to the positions which are 45° from their original positions, the links 14, 14, 30, 30 become straight as shown in FIG. 15, respectively. At this time, the door 19 is under the state where it crosses orthogonally the upper and lower support frames 6, 24.

When the upper and lower support frames 6, 24 rotate further, the links 14, 14, 30, 30 start bending gradually in the reverse way to the first state and when the upper and lower support frames 6 and 24 reach the final positions where they are in parallel with the sidewall W, the links 14, 14, 30, 30 are bent completely to the side opposite to the initial state and at the same time, the pins 17, 33 move on the opposite side, too, so that the door 19 approaches to the sidewall in parallel with it.

Figure 18:
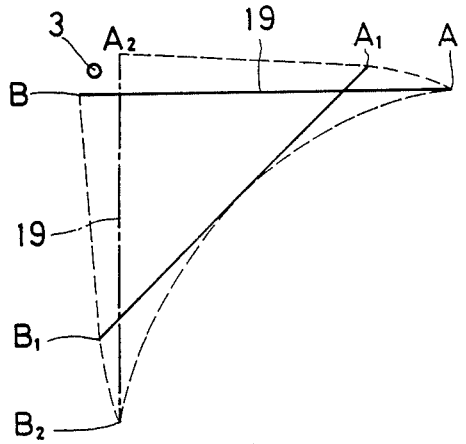
FIG. 18 is an explanatory view of the moving orbit of the door.

FIG. 18 shows the moving orbit of the door. Symbol A represents the end portions of the upper and lower support beds 2, 21 of the door 19 on the side opposite to the round pillars 3, 22 and B does the end portions on the side of the round pillars 3, 22.

Solid line represents the state where the door is closed. As the door rotates from this state and reaches the state shown in FIG. 15, the position is represented by $A_1$, $B_1$ and the door stops finally at the position $A_2$, $B_2$ represented by one-dot chain line.

Figure 19:
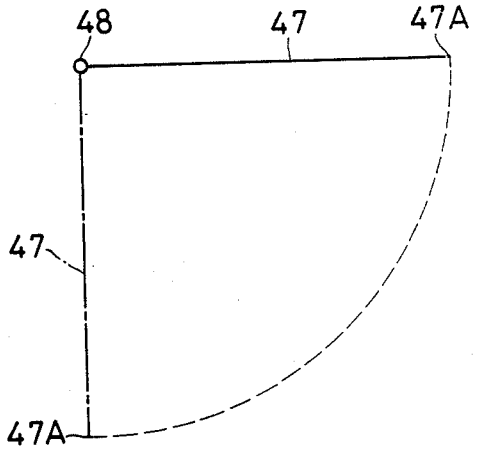
FIG. 19 is an explanatory view of the moving orbit of a conventional door.

FIG. 19 shows the moving orbit of the conventional door for the purpose of comparison with the door in accordance with the present invention. The door 47 swings with hinges 48 being the support point and the free end 47A of the door describes an arcuate orbit as represented by two-dot chain line.

Since the door apparatus of the present invention has the construction and action as described above, one door rotates while moving horizontally to the right or left and finally approaches to the sidewall of the entrance and becomes in parallel therewith. Accordingly, one need not take a step backward or turn sideways when he opens the door as required for the conventional swing door, but can move straight as such. Therefore, the handicapped or those who use the wheelchair can smoothly and easily pass through the door. Since the door is fully open while becoming in parallel with the sidewall of the entrance, the door apparatus of the present invention can be used most suitably for a narrow passage. Furthermore, since the door apparatus of the invention can be fully opened rapidly by limited force of operation, one can pass through the door smoothly, and the rhythmic door operation is indeed pleasant. Since the number of necessary components is small, the door apparatus of the invention can be produced at a low cost of production. Additionally, the door apparatus of the present invention can be applied to doors of furniture, too.

While the present invention has been described and illustrated with respect to a specific embodiment thereof, it is to be noted that various changes or modifications may be made by those skilled in the art without departing from the spirit and scope thereof.

What is claimed is:

1. A door apparatus comprising:

an upper stay consisting of:

an upper support bed fixed to a sidewall of an entrance in such a manner as to extend horizontally therefrom, and equipped with a round pillar projecting from a flat upper surface of said upper supported bed, with a through-hole at the center of said round pillar and with a pin implanted at a diagonal position of 45° to a line at right angles to the sidewall of the entrance;

an upper support frame having a thinly elongated box shape whose both end portions are rounded, having a fitting hole for said round pillar formed in a box bottom at one of the end portions thereof, supported rotatably in the horizontal direction when said round pillar is fitted into said fitting hole, and said upper support frame having an elongated hole in the circumferential direction at an arc-shaped sidewall portion at the other end portion thereof;

a support shaft implanted in the box bottom of the end portion opposite to said round pillar and inside said upper support frame;

an arm rod rotating horizontally and supported by said support shaft at one end and at the other end connected to the center of said door in the transverse direction;

two pins implanted, with a predetermined spacing between then and on a line connecting the center of said round pillar to the center of said support shaft, in the box bottom and inside said upper support frame; and two lever arms linked together at one end (links as a pair), each lever arm equipped with a centrally located axially elongated hole into which one of said upper support frame pins are fitted slidably, and having the second end of one lever am rotatably connected to said support bed pin and the second end of the other lever arm connected to a second pin implanted at substantially the center of said arm rod and parallel to the support shaft and, said linked lever arms having a full length equal to the distance between the center of said round pillar and the center of said support shaft;

a lower stay having the same construction as that of said upper stay;

a door supported by said arm rods of said upper and lower stays;

an interlocking shaft fitted to said through hole of said upper support bed in said upper stay, and having the upper end thereof connected to a ceiling part of said upper support frame and the lower end of said interlocking shaft connected to said lower support frame in said lower stay; and a rotation means for horizontally rotating said upper support frame in said upper stay with said round pillar of said upper support bed being the support point of rotation.

* * * * *